US005438775A

United States Patent [19]

Chietti et al.

[11] Patent Number: 5,438,775

[45] Date of Patent: Aug. 8, 1995

[54] METHOD AND MACHINE FOR AUTOMATICALLY IRONING AND STACKING MEN'S SOCKS

[75] Inventors: Teresa Chietti, S. Casciano val di Pesa; Alberto Frullini, Via di Brozzi, 151/A, 50145 Florence; Nerina Naim, Scandicci, all of Italy

[73] Assignees: FA-MA di Maselli Maria e Frullini Alberto & C.S.n.c., Fract. S.; Alberto Frullini; Nerina Naim, both of Florence, all of Italy

[21] Appl. No.: 191,970

[22] Filed: Feb. 3, 1994

[30] Foreign Application Priority Data

Feb. 4, 1993 [IT] Italy ..... FI93A14

[51] Int. Cl.[6] ..... D06F 71/04; D06F 59/06; D06C 7/02

[52] U.S. Cl. ..... 38/23; 223/76

[58] Field of Search ..... 38/1 A, 2, 3, 4, 5, 38/7, 23, 71; 223/75, 76; 209/528, 556, 705, 643, 617; 198/394; 414/222

[56] References Cited

U.S. PATENT DOCUMENTS

| | | | |
|---|---|---|---|
| 2,838,217 | 6/1958 | Bowman et al. | 223/76 X |
| 3,112,847 | 12/1963 | Brumby | 38/5 X |
| 3,262,616 | 7/1966 | Harralson | 223/76 |
| 3,333,748 | 8/1967 | Horberg, Jr. | 223/76 |
| 3,353,726 | 11/1967 | Kronsbein | 223/76 X |
| 4,703,877 | 11/1987 | Kuniki et al. | 223/76 X |
| 5,094,371 | 3/1992 | Takamura et al. | 223/76 |

*Primary Examiner*—Clifford D. Crowder
*Attorney, Agent, or Firm*—McGlew and Tuttle

[57] ABSTRACT

A machine for ironing and stacking men's socks comprising:—a circular plate 1 with a central horizontal shaft 12;—an electric motor 2;—a plurality of socks-supporting flat shapes 10 equally spaced apart along a circumference of the plate 1, projecting from the same face thereof 1, oriented almost tangentially thereto, and having a horizontal shaft 13;—a curvilinear cam 3 located opposite to the shapes 10 with respect to the plate 1 to operate the rotation of each shape 10, in cooperation with a corresponding feeler 15 provided with a return spring 16;—a chamber 4 for steaming and pressing the socks;—a chamber 5 for pressing and drying the socks;—a clamp 6 for withdrawing the thus ironed sock, with the leg and foot thereof in horizontal position, by acting in correspondence of the foot 14 region, and placing the sock onto an underlying horizontal belt conveyer 7;—a plurality of suction nozzles 9 borne by a horizontal arm 90 for the vertical removal and lifting of the thus withdrawn and faultless sock, and for the transfer thereof to a separate movable dwell surface;—a device for signalling and storing in memory the position of the shapes 10 having a faulty sock thereon and activating said clamp 6 and said arm 90 by a Programmable Logic Circuit (PLC)-type device which can be associated to an operator-actuated push-button.

21 Claims, 7 Drawing Sheets

METHOD AND MACHINE FOR AUTOMATICALLY IRONING AND STACKING MEN'S SOCKS

FIELD OF THE INVENTION

The present invention refers to a method and a machine for automatically ironing and stacking men's socks.

BACKGROUND OF THE INVENTION

It is known to those skilled in the art that the current machines for steam ironing of socks comprise a plurality of vertical flat shapes on which the socks are manually loaded by an operator, the shapes being associated to corresponding driving means to allow the transit and the temporary dwell thereof in a steaming and pressing chamber to operate the ironing thereof.

It is also known that the dry ironing of the socks is carried out directly on the relevant vertical support shapes, which are electroheated.

It is further known that, upon completion of the ironing, the socks are either manually or automatically picked up and then stacked for packaging. In order to automatically stack the thus ironed socks an apparatus is known comprising a clamp for the withdrawal of the socks and the subsequent lying thereof on a corresponding dwell plane able to form an abutting element for an oscillating plate operating the pressing of the socks laid down thereon.

However, the operation of fitting the socks to be ironed on the relevant support shapes takes place with difficulty inasmuch as the shapes are disposed in a vertical position both during the fitting operation and the subsequent stages of the ironing process, so that also the inspection of the socks for the detection of possible faults is not easily performed. In addition to this, there is the fact that the separation of the faulty socks from the integral ones is not automatic and, therefore, the operator must withdraw the faulty socks from the relevant support shapes prior to the ironing of the socks, thereby consuming some of the time for the loading of the other shapes of the machine and thus reducing its output capacity. Alternatively, an ancillary operator must be put in charge of the operation for the withdrawal of the faulty socks, which implies a higher cost of the finished socks. Besides, these known machines do not allow the stacking of any preset number of ironed socks as the lowering of the above mentioned pressing plate is heavily hindered by the thickness of the same socks being stacked in case the latter are present in large quantity.

SUMMARY AND OBJECTS OF THE INVENTION

The main object of the present invention is to overcome the above mentioned drawbacks.

This result has been achieved, according to the invention, by adopting an operating method comprising, in sequence, the following steps:

(a) fitting individually and in continuous succession the socks to be ironed on the corresponding support means distributed along a circumference having a horizontal axis, in a horizontal position and with the foot turned towards the operator, and inspecting the sock side that can be viewed by the operator in order to detect the presence of any fault;

(b) individually rotating the socks thus supported around the horizontal axis through an are of predetermined angular extension, that is, by one step, and simultaneously rotating the support means of the thus fitted sock, around a horizontal axis, through an are of predetermined angular extension to allow the inspection of the side opposite to the one viewable when fitting the sock thereon;

(c) signalling the position of any faulty sock upon completion of the inspection;

(d) rotating the socks one step further together with the relevant support means and performing the ironing of the thus inspected sock;

(e) rotating the socks still further by one or more steps together with the relevant support means and moving the thus ironed sock away from the relevant support, through a horizontal movement, by acting in the region of the sock in correspondence of the foot;

(f) withdrawing the thus removed sock to operate the successive stacking in case of lack of faults;

(g) stacking a predetermined number of thus withdrawn socks to allow the successive packaging thereof in single or multiple pairs.

As far as the machine for carrying out the method is concerned, it comprises:

a circular plate with horizontal central shaft;

means for driving the plate, with an electric motor and a transmission for the connection of the shaft;

a plurality of flat shapes for supporting the socks to be ironed, equally spaced apart along a circumference of the plate, projecting from the same face of the plate and oriented almost tangentially thereto, each of the which shapes being provided with a horizontal rotary shaft;

cam means for driving each sock-supporting shape into rotation about the relevant shaft in correspondence of the socks fitting station, between a position almost tangent to the plate and a radial position, and vice versa;

means for signalling and memorizing the position of the shapes supporting the faulty socks, with a control device of Programmable Logic Circuit (PLC) type which can be associated to an operator-actuated push-button;

means for carrying out the ironing of the socks, with a steaming and pressing chamber located above the rotary shaft of the shapes supporting plate, and a pressing and drying chamber which is disposed downstream of the steaming chamber;

means for withdrawing the thus ironed sock, with the leg and foot thereof in horizontal position, by means of a clamp acting in correspondence of the foot region, from both sides of the sock, and which moves away from the relevant shape through a straight travel extending in alignment with the axis of the sock foot, until it releases the sock onto an underlying horizontal belt conveyer at one end of which a container is provided for collecting the waste, that is, the faulty socks;

pneumatic grip means for withdrawing and lifting the thus removed faultless sock and for the transfer thereof over a movable dwell plane to perform the stacking thereof in a predetermined number of pairs so as to allow for the successive packaging thereof.

The advantages which can be obtained from the present invention lie essentially in that it is possible to operate the loading of the socks to be ironed on the respective support shapes with greater simplicity and rapidity owing to the horizontal position of the latter in the loading station, which requires a less physical effort by the operator; that it is possible to easily inspect both sides of the socks to be ironed and detect the presence of possible defects to operate the successive automatic removal of the faulty socks; that a machine according to the invention is of limited dimensions, in relation to its production capacity; that it can easily be provided with any known device for the packaging of the stacked socks; and that it is of simple construction and reliable even after a much prolonged service life.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1A:
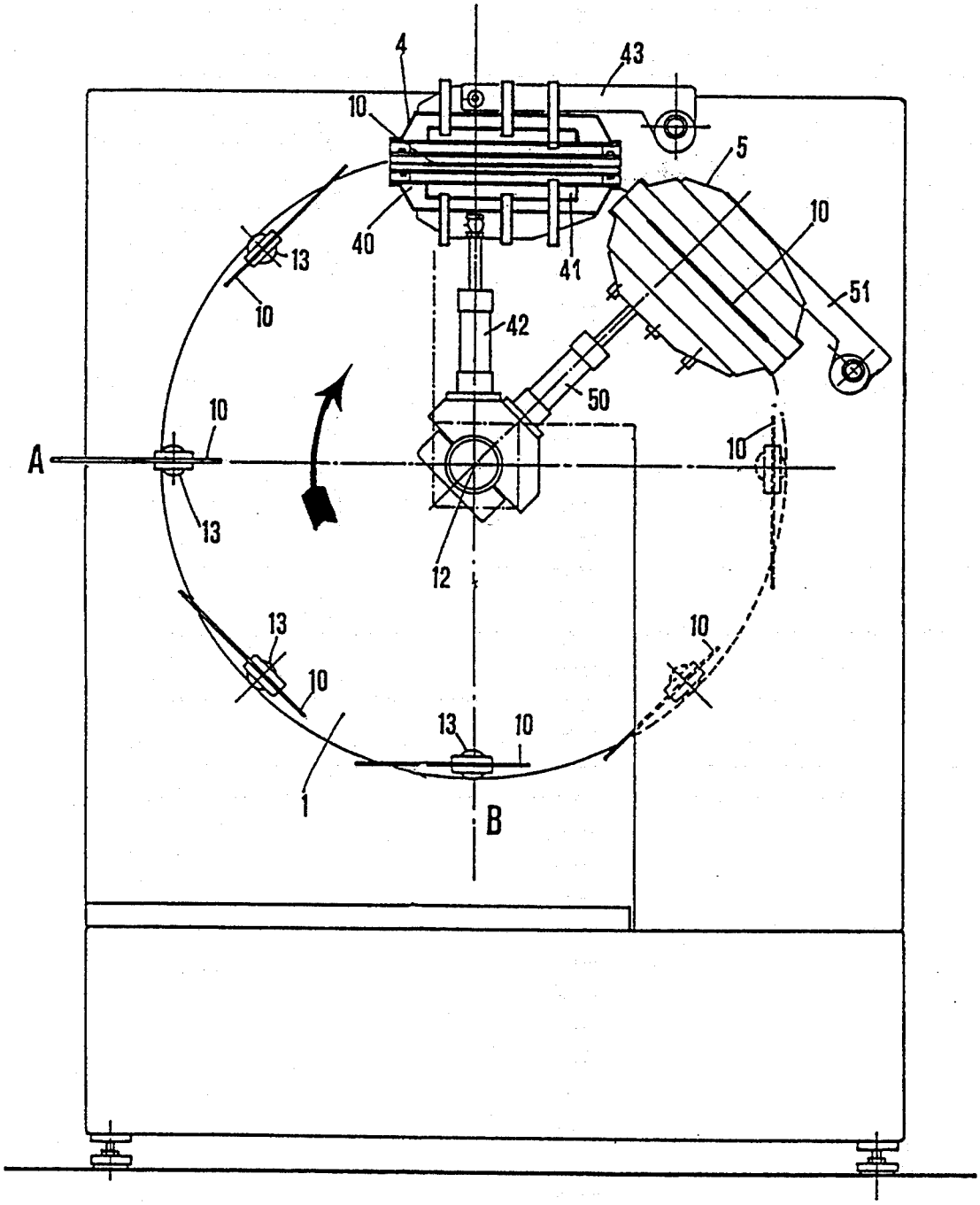
FIG. 1A shows schematically a partially cross-sectioned view of a machine according to the invention, with a socks steaming chamber and a socks drying chamber.
Figure 1B:
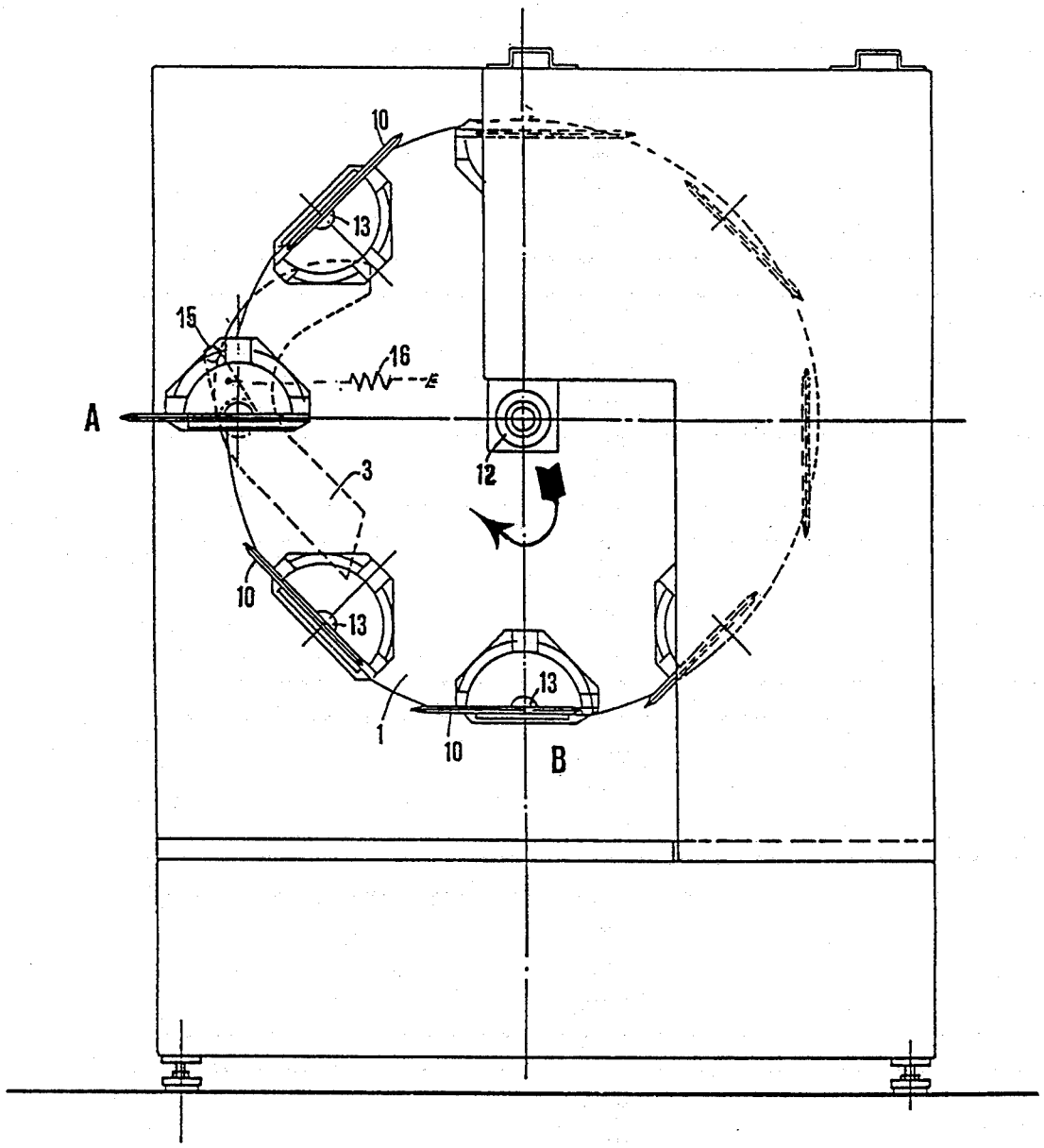
FIG. 1B shows schematically a partially cross-sectioned view of the machine, with the cam for driving the socks supporting shapes.
Figure 2A:
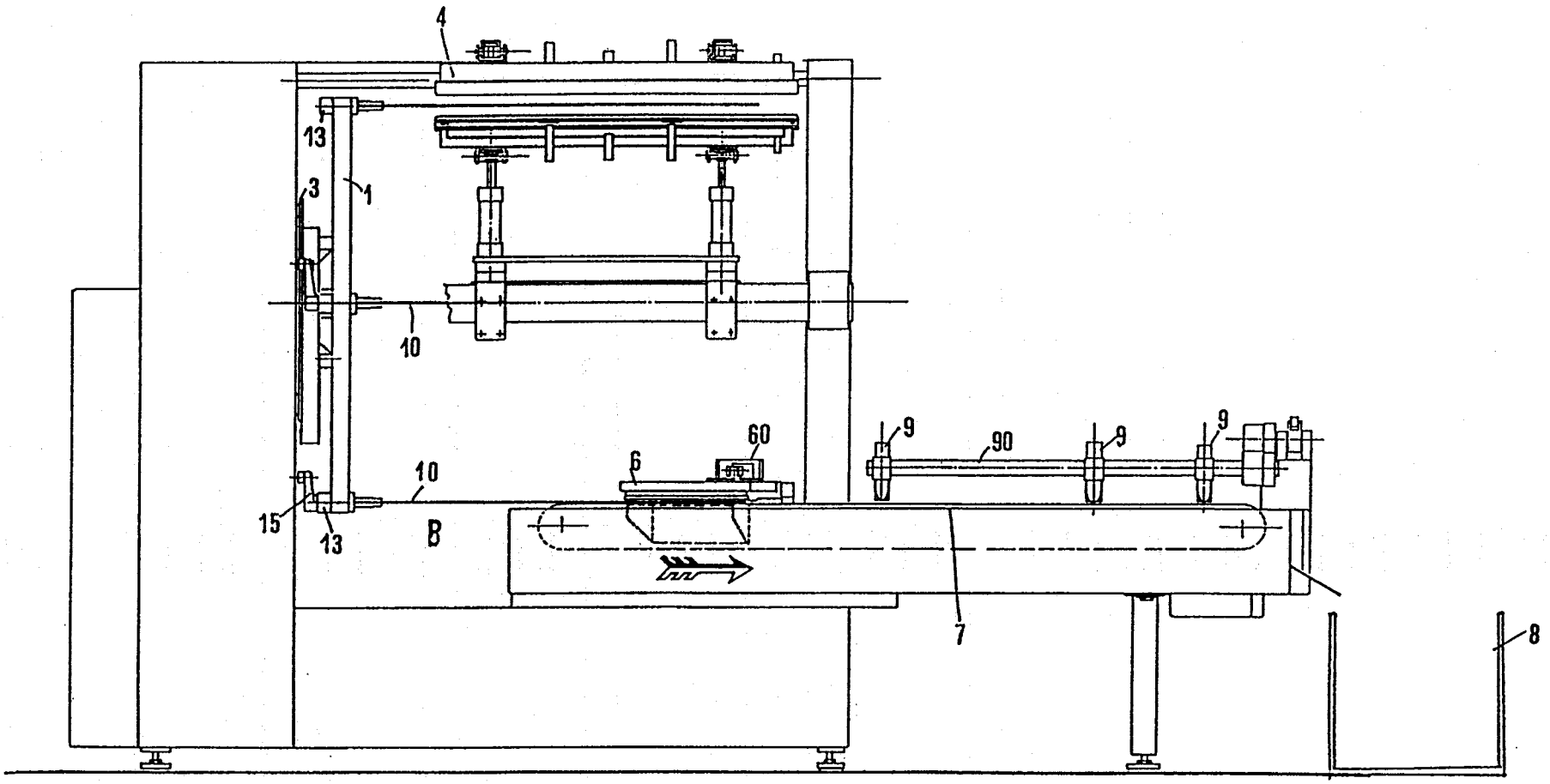
FIG. 2A shows schematically a view in longitudinal section of the machine of FIGS. 1A and 1B upon the withdrawal of a sock removed from the relevant support shape.
Figure 2B:
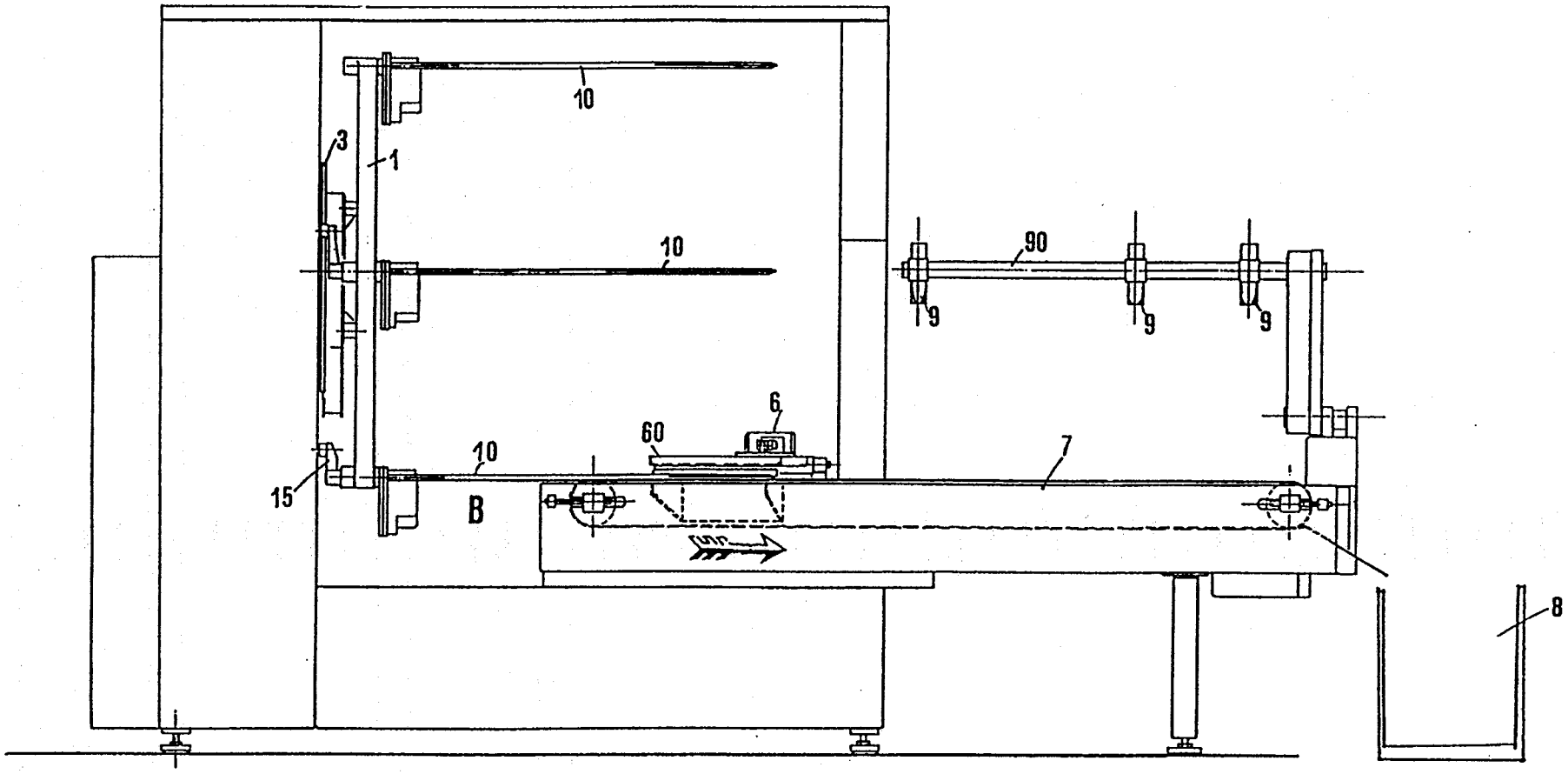
FIG. 2B shows the machine of FIG. 2A with the socks stacking member in an inoperative condition.
Figure 3B:
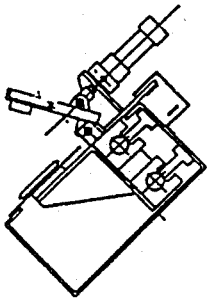
FIG. 3B shows the section taken on line 3B—3B of FIG. 3A.
Figure 3A:
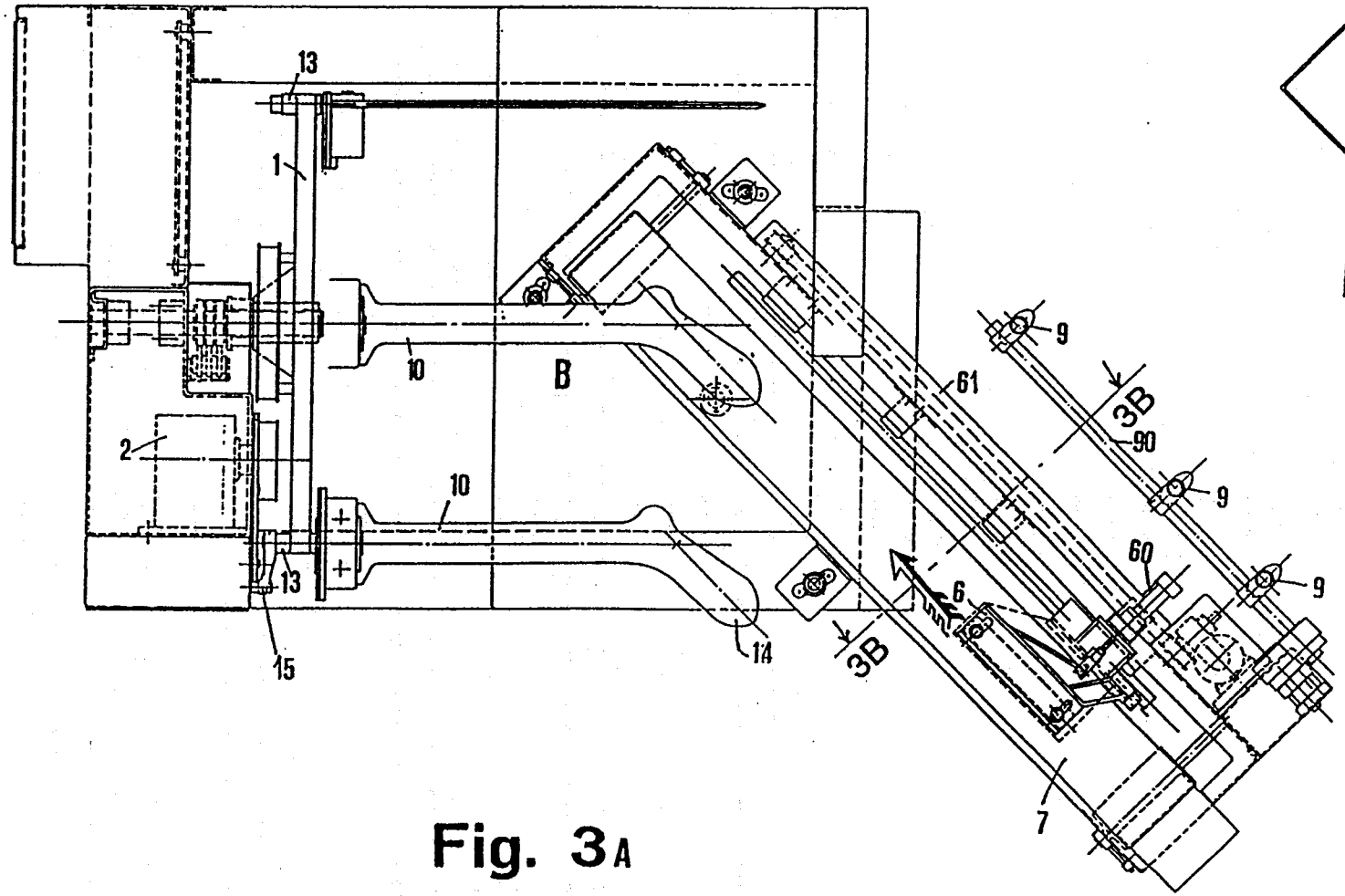
FIG. 3A shows schematically a plan view partially in section, of the machine of FIG. 2B with support shapes for traditional men's socks.
Figure 4:
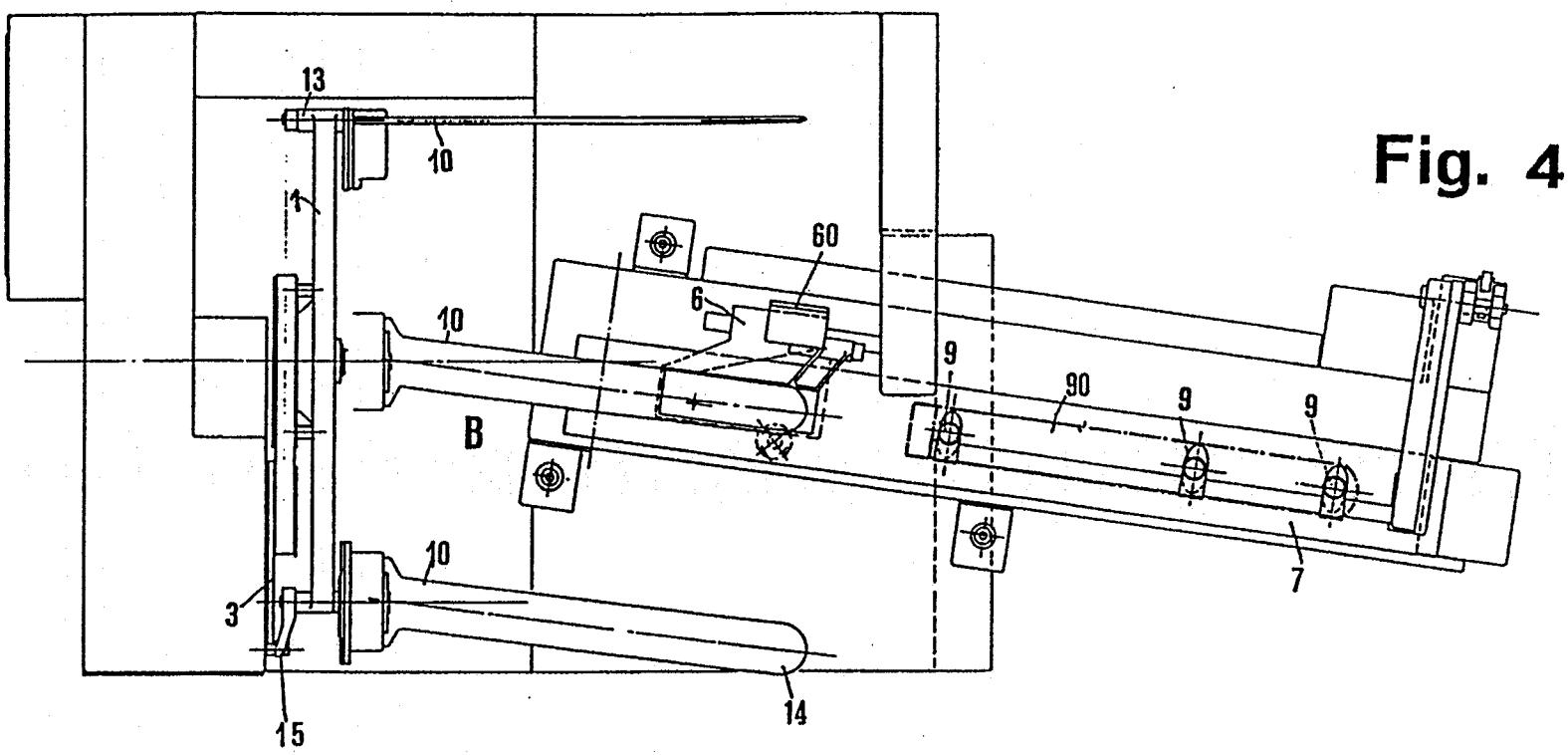
FIG. 4 shows schematically a plan view, partially in section, of the machine of FIG. 2A with support shapes for "basket"-type socks.

Reduced to its basic structure, and reference being made to the attached drawings, a method for ironing and stacking the men's socks, according to the invention, comprises the following operating steps:

(a) fitting at a loading position, individually and in continuous succession, the socks to be ironed on corresponding sock support means 10 distributed along a circumference having a horizontal axis 12, in a horizontal position and with the foot 14 turned towards the operator, and inspecting the sock side that can be viewed by the operator in order to detect the presence of any fault;

(b) individually rotating, in clockwise direction, the socks thus supported around the horizontal axis 12 through an arc or path of predetermined angular extension, that is, through one step, or increment to a second side inspection position and simultaneously rotating the support means 10 of the thus fitted sock, around a horizontal sock support axis of the sock support, through an arc of predetermined angular extension to allow for the inspection of the side opposite to the one viewable when fitting the sock thereon;

(c) signalling or marking the position of any faulty sock upon completion of the inspection;

(d) rotating the socks one step further together with the relevant support means to an ironing position and performing the ironing of the thus inspected sock;

(e) rotating the socks still further by one or more steps together with the relevant support means and moving the thus ironed sock away from the relevant support, through a horizontal movement, by acting in the region of the sock in correspondence of the foot 14;

(f) withdrawing the thus removed sock to operate the successive stacking in case of lack of faults:

(g) stacking a predetermined number of thus withdrawn socks to allow the successive packaging thereof in single or multiple pairs.

According to the invention, provision is made, advantageously, for carrying out the dry ironing by heating the socks directly on the relevant support means.

Also advantageously, provision is made for carrying out the steam ironing of the sock in two stages, successively to the inspection step (b), by a hot steam-operated wetting and a pressing of the sock, and then by a pressing and a heat-removal-operated drying of the sock.

It is further advantageously provided for prolonging the sock drying step until the removal thereof from the support means.

As far as the machine for carrying out the method is concerned, according to the invention, it comprises:

a base;

a circular plate 1 with central horizontal shaft 12;

an electric motor 2 for driving the shaft 12 into motion;

a plurality of flat shapes 10 supporting the socks to be ironed are equally spaced apart along a circumference of the plate 1, the shapes 10 project from the same face of the plate 1 and are oriented almost tangentially thereto, each of these shapes 10 being provided with a rotary horizontal shaft 13;

a cam 3 is positioned at a sock turning position of the base, the cam 3 having a curvilinear profile located opposite to the shapes 10, with respect to the plate 1, to drive each shape 10 into rotation about its relevant shaft 13 in correspondence of the socks fitting station, between a position almost tangent to the plate and a radial position, and vice versa, in cooperation with a corresponding feeler 15 provided with a return spring 16 and connected to the base of each shape 10;

a chamber (4) for steaming and pressing the socks, which is located above the shaft 12 for the rotation of the shapes supporting plate 1;

a chamber 5 for pressing and drying the socks, which is located immediately downstream of the steaming chamber 4;

a clamp 6 for withdrawing the thus ironed sock, with the leg and foot thereof in horizontal position, acting in correspondence of the foot 14 region on both sides of the sock, and moving away from the relevant shape 10 through a straight travel developing in alignment with the axis of the sock foot 14, until it releases the sock onto an underlying horizontal belt conveyer 7 at one end of which a container 8 is provided for collecting the waste, that is, the faulty socks;

a plurality of suction mouthpieces or nozzles 9 borne by a horizontal arm removal means 90 for the vertical withdrawal and lifting of the thus removed and faultless sock, and for the transfer thereof to a separate movable dwell surface, not shown, to operate the stacking thereof, in a predetermined number of pairs, and thus allowing the successive packaging thereof;

marking means known per se, not shown for the sake of clarity, for signalling and memorizing the position of the support shapes 10 having a faulty sock thereon and activating the clamp 6 and the arm 90 by a Programmable Logic Circuit (PLC)-type device which can be associated to an operator-actuated push-button.

Advantageously, according to the invention, the shapes 10 are electroheated to allow the socks to be dry-ironed by direct heating, and also to allow the drying thereof to be prolonged outside and beyond the chamber 5.

Alternatively, in order to further ease the drying of the socks being ironed, an infrared ray lamp, not shown for clarity in the attached drawings, is provided downstream of the chamber 5.

Also, alternatively, an aspirator for aspirating the wet air, not shown in the drawing, is provided downstream of the chamber 5 to dry the ironed socks.

Advantageously, according to the invention, the motor 2 for driving the plate 1 may be either of stepping, or brushless or jog-asynchronous type.

Besides, advantageously, reference being made to FIG. 1A of the attached drawings, the chamber 4 for the wetting of the socks, comprises a manifold 40 for collecting the steam produced by an external source, and which is connected via a valve to a dispensing compartment 4 provided with a plurality of holes for the output of the steam, so as to allow for the wetting of the sock upon the ironing stage. The chamber 4 is openable by an operating cylinder 42 having its stem connected to one of the two sides of the chamber 4 and with a lever 43 connected to the diametrically opposite side of same chamber 4, with respect to cylinder 42, and hinged to the frame of the machine, so as to allow for the input and the pressing of the sock to be wetted, along with the relevant support shape 10 and, afterwards, the output thereof.

Moreover, advantageously, the chamber 5 for the drying and pressing of the socks being ironed in the previous chamber 4, comprises an electric resistance for drying the socks, a manifold for collecting the hot steam and means for blowing the ambient air into the chamber 5 so as to allow a fast removal of the steam from the chamber 5. The chamber 5 is openable by an operating cylinder 50 and a corresponding lever 51 hinged to the frame of the machine, to allow for the input and the pressing of the socks which have been previously wetted and pressed.

Advantageously, according to the invention and with reference to FIGS. 1A–4 of the attached drawings, the clamp 6 is supported by a carriage 60 movable on a straight guide parallel to the axis of the foot 14 of the thus ironed and dried sock.

Figure 5:
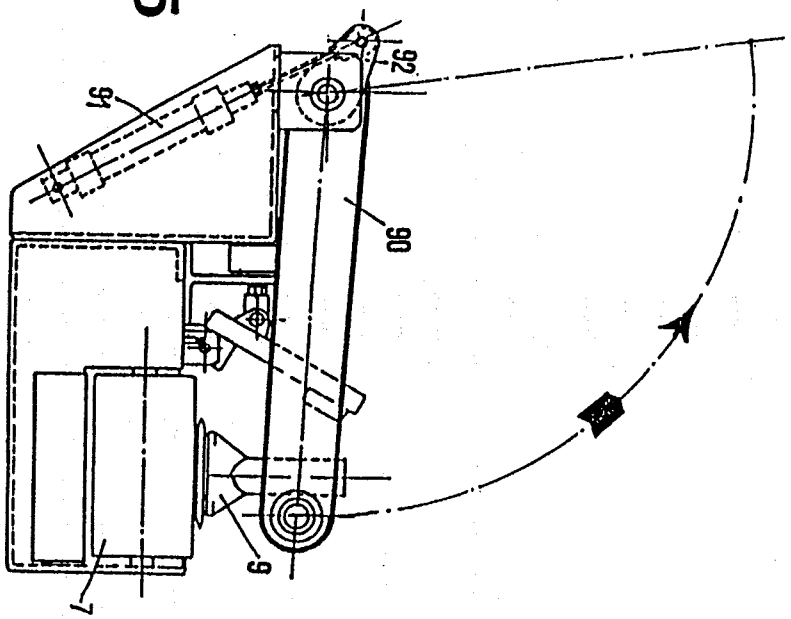
FIG. 5 shows the detail of the members for the withdrawal of the socks removed from the respective support shapes.

With reference to FIG. 5 of the attached drawings, the arm 90 for supporting the suction mouthpieces 9, is associated to a corresponding operating cylinder 91 via a lever 92 which is connected on one side to the arm 90 and on the other to the stem of the cylinder 91, so as to allow the sock to be lifted while maintaining its horizontal position.

The operation of the above described machine is as follows.

When a sock to be ironed is fitted on the relevant support shape 10 at the loading station A, the operator inspects the viewable side of the sock. Then, the plate 1 rotates through an are corresponding to one step. This rotation causes the engagement of the feeler 15 of the shape 10 with the cam 3 which drives the shapes into rotation about the respective shafts 13. In this way, the shape 10 with the sock inspected on one side, places itself almost tangent to the plate 1, thereby showing the other side to the operator who is thus able to inspect it. Upon completion of the inspection on both sides, in case of the presence of defects on at least one of the two sides of the sock, the operator signals the position of the shape 10 on which the faulty sock is put, by simply acting on a push-button associated to the PLC-operated control system so as to store the position in memory. Afterwards, the sock is wetted and pressed inside the chamber 4 and then further pressed and dried inside the chamber 5. At the end of the drying stage, the clamp 6 provides for the removal of the sock from the relevant shape 10. During the initial stage of this operation, the clamp 6 has one jaw disposed above the sock and the other below the belt conveyer 7 and acts in correspondence of the foot 14 of the sock, so as to allow the removal thereof in the direction of the extension of the axis of foot 14 consequently to the movement of carriage 60. At the end of this removal, the clamp 6 releases the sock which, in this way, is made to lay down on the belt conveyer 7 which transfers it in correspondence with the socks stacking mouthpieces or nozzles 9. Afterwards, by a command of the PLC-operated control system, the arm 90 for the support of the mouthpieces 9 is lowered and the suction of the air is activated through the mouthpieces 9 to allow for the withdrawal of the thus transferred sock. Afterwards, the arm 90 is lifted by means of the corresponding cylinder 91 as far as to bring the sock at the level of the belt for the dwell of the socks to be stacked. In case the sock is faulty, the PLC system does not operate the lowering of the arm 90 and, consequently, the faulty sock laid down on the belt conveyer 7 is unloaded into the waste collecting container 8. The socks thus stacked on the dwell belt, in a predetermined number of pairs, are then removed either manually or automatically to carry out the subsequent packaging thereof.

Practically, all the construction details may vary in any equivalent way as far as the shape, dimensions, elements, disposition, and nature of the used materials are concerned, without nevertheless departing from the scope of the adopted solution idea and, thereby, remaining within the limits of the protection granted to the present patent for industrial invention.

We claim:

1. A method for ironing and stacking socks, the method comprising:

providing a plate with a plurality of sock supports positioned along a circumference of said plate;

individually placing one of the socks on one of said sock supports at a loading position with a first side of a foot of the sock facing an operator;

inspecting the first side of the sock at said loading position;

moving the sock with said one sock support to a second side inspection position;

rotating said one sock support to have a second side of the sock face the operator at said second side inspection position, said second side being substantially opposite said first side;

inspecting said second side of the sock;

marking the sock if the sock fails inspection;

moving the sock with said one sock support from said second side inspection position to an ironing position;

ironing the sock on said one sock support at said ironing position;

moving the sock with said one sock support from said ironing position to a removal position;

removing the sock from said one sock support at said removal position;

transporting the removed sock along a second path;

removing the sock from said second path for further packaging if the sock has passed inspection.

2. A method in accordance with claim 1, wherein:

moving of said sock supports are by rotation of said plate.

3. A method in accordance with claim 2, wherein:

said rotation of said plate moves each of said plurality of sock supports, and moves another one of said plurality of sock supports into positions that said one sock support has moved out of.

4. A method in accordance with claim 2, wherein:

said rotation of said plate is about a substantially horizontal axis.

5. A method in accordance with claim 1, wherein:

said ironing is dry ironing by heating the sock on said one sock support.

6. A method in accordance with claim 1, wherein:

said ironing is performed in two stages, a first stage being hot steam wetting and pressing of the sock, and a second stage being drying of the sock.

7. A method in accordance with claim 6, wherein:

said drying of the sock is prolonged until said removing of the sock from said one sock support at said removal position.

8. A method in accordance with claim 1, further comprising:

moving the sock along said second path into a waste container if the sock has failed inspection.

9. An apparatus for ironing and stacking socks, the apparatus comprising:

a base;

a plate mounted on said base and rotatable about an axis;

a plurality of sock supports positioned rotatably on said plate about a sock support axis of each of said plurality of sock supports;

cam means positioned at a sock turning position of said base and for rotating said plurality of sock supports about a respective sock support axis when a respective sock support moves to said sock rotating position by rotation of said plate;

means for ironing the socks on said plurality of sock supports, said means for ironing being positioned on said base and rotation of said plate moving said plurality of sock supports to said means for ironing;

a belt conveyor positioned on said base;

clamp means for removing one of the socks from one of said plurality of sock supports and for depositing the sock onto said belt conveyor, said clamp means being positioned on said base, and rotation of said plate moving said plurality of sock supports to said clamp means;

arm removal means for removing the socks from said belt conveyor means for further packaging.

10. An apparatus in accordance with claim 9, further comprising:

marking means for marking by an operator a faulty sock on one of said plurality of sock supports during an inspection by the operator; and said arm removal means removes socks not marked as faulty.

11. An apparatus in accordance with claim 10, further comprising:

a waste container positioned at an end of said belt container and collecting socks marked as faulty.

12. An apparatus in accordance with claim 9, wherein:

said plate is substantially circular and said axis of said plate is substantially horizontal;

said sock supports are substantially flat and substantially equally spaced apart along a circumference of said plate, said sock supports project from a same face of said plate and are orientated substantially tangential to said circumference;

said cam means is positioned on a side of said plate substantially opposite from said sock supports, and said cam means rotates said sock supports between a tangential position and a radial position, said cam means includes a feeler with a return spring connected to a base of each of said sock supports;

said ironing means includes a first chamber means for steaming and pressing the socks, and said ironing means also includes second chamber means for pressing and drying the socks, said second chamber means being positioned downstream of said first chamber means;

said damp means removes one of the socks from said one sock support when a leg and foot portion of the one sock are substantially horizontal, said clamp means clamps the foot portion and moves away from said one sock support in a direction substantially in alignment with an axis of the foot portion;

said arm removal means is substantially horizontal and includes a plurality of suction nozzles for substantially vertical withdrawal of the socks.

13. An apparatus in accordance with claim 12, wherein:

said first chamber means of said ironing means includes a manifold means for collecting steam produced by an external source, said manifold means being connected via a valve to a dispensing compartment, said dispensing compartment defining a plurality of holes for expelling steam and causing wetting of socks in the first chamber means.

14. An apparatus in accordance with claim 12, wherein:

said first chamber means is openable by an operating cylinder having a stem connected to one side of said first chamber means and a lever which is connected to another side of said first chamber means diametrically opposite said one side, said another side of said first chamber means being hinged to said base.

15. An apparatus in accordance with claim 12, wherein:

said second chamber means includes an electrical resistance for drying the socks, a manifold for collecting hot steam, and means for blowing ambient air into said second chamber means.

16. An apparatus in accordance with claim 12, wherein:

said second chamber means is openable by an operating cylinder and a corresponding lever hinged to said base.

17. An apparatus in accordance with claim 12, wherein:

said clamp means includes a carriage movable on a straight guide substantially parallel to said axis of the foot portion of the one sock.

18. An apparatus in accordance with claim 12, wherein:

said arm removal means includes a corresponding operating cylinder means to cause the sock to be lifted by the arm removal means while maintaining a substantially horizontal position.

19. An apparatus in accordance with claim 9, wherein:

said plurality of sock supports are electroheated.

20. An apparatus in accordance with claim 9, further comprising:

a motor for driving said plate, said motor is one of a stepping type, a brushless type and an asynchronous type with jog means.

21. A method for ironing and stacking socks, the method comprising:

providing a plate with a plurality of sock supports;

individually placing one of the socks on one of said sock supports;

inspecting a first side of the sock facing an operator;

rotating said one sock support to have a second side of the sock face the operator, said second side being substantially opposite said first side;

inspecting said second side of the sock facing an operator;

marking the sock if the sock fails inspection;

moving the sock with said one sock support along a path;

ironing the sock on said one sock support along said path;

further moving the ironed sock with said one sock support along said path;

removing the ironed sock from said one sock support after said further moving;

transporting the removed sock along a second path;

removing the sock from said second path for further packaging if the sock has passed inspection.

* * * * *

UNITED STATES PATENT AND TRADEMARK OFFICE

CERTIFICATE OF CORRECTION

PATENT NO. : 5,438,775

DATED : August 8, 1995

INVENTOR(S) : CHIETTI et al.

It is certified that error appears in the above-identified patent and that said Letters Patent is hereby corrected as shown below:

On the title page, item:

[73] Assignees: FA-MA di Maselli Maria e Frullini Alberto & Co. S.n.c., Fract. S. Donnino, Italy Signed and Sealed this Twenty-fifth Day of February, 1997

*Attest:*

BRUCE LEHMAN

*Attesting Officer*

*Commissioner of Patents and Trademarks*